US011457727B1

(12) United States Patent
Weber

(10) Patent No.: US 11,457,727 B1
(45) Date of Patent: Oct. 4, 2022

(54) TRAVEL TRAY ASSEMBLY

(71) Applicant: Dorothy Weber, Eureka, CA (US)

(72) Inventor: Dorothy Weber, Eureka, CA (US)

( * ) Notice: Subject to any disclaimer, the term of this patent is extended or adjusted under 35 U.S.C. 154(b) by 0 days.

(21) Appl. No.: 17/381,257

(22) Filed: Jul. 21, 2021

(51) Int. Cl.
*A47B 3/10* (2006.01)
*A47B 23/06* (2006.01)
*A45C 13/00* (2006.01)

(52) U.S. Cl.
CPC ..... *A47B 3/10* (2013.01); *A47B 23/06* (2013.01); *A45C 13/001* (2013.01)

(58) Field of Classification Search
CPC ..... A47B 3/10; A47B 23/06; A47B 23/001
See application file for complete search history.

(56) References Cited

U.S. PATENT DOCUMENTS

| | | | | |
|---|---|---|---|---|
| D653,083 | S | 1/2012 | Hatcher | |
| 8,485,327 | B1 | 7/2013 | Dalrymple | |
| 8,955,656 | B1 * | 2/2015 | Foster | A45C 5/03 108/17 |
| 9,332,835 | B2 | 5/2016 | Shannon | |
| 9,474,346 | B2 | 10/2016 | Simon | |
| 9,526,329 | B2 | 12/2016 | Glover | |
| 10,285,495 | B1 * | 5/2019 | Valme | A47B 13/081 |
| 10,561,234 | B1 * | 2/2020 | von Goins | A45C 11/00 |
| 2007/0158156 | A1 | 7/2007 | Chen | |
| 2013/0032443 | A1 * | 2/2013 | Soedomo | 190/11 |
| 2014/0299428 | A1 | 10/2014 | Gadbois | |
| 2016/0022032 | A1 * | 1/2016 | Simon | A45C 13/28 108/42 |
| 2016/0037905 | A1 * | 2/2016 | Glover | A47B 3/12 108/42 |
| 2016/0045022 | A1 * | 2/2016 | Shannon | A47B 13/16 108/166 |
| 2016/0081469 | A1 | 3/2016 | Undesser | |
| 2016/0353878 | A1 * | 12/2016 | Nelson | A47B 5/02 |
| 2017/0086576 | A1 * | 3/2017 | Smith | A45C 13/262 |
| 2017/0325560 | A1 * | 11/2017 | Williams | A47B 5/04 |
| 2018/0116353 | A1 * | 5/2018 | Howell | A45C 9/00 |
| 2021/0076791 | A1 * | 3/2021 | DeVeaux | A45C 9/00 |
| 2022/0175166 | A1 * | 6/2022 | Avellanet | A45C 13/001 |

FOREIGN PATENT DOCUMENTS

| | | |
|---|---|---|
| WO | WO2016200982 | 12/2016 |

* cited by examiner

*Primary Examiner* — Daniel J Rohrhoff

(57) ABSTRACT

A travel tray assembly for carrying food items on an article of luggage includes an article of luggage that has dimensions that conform to carry-on requirements of commercial airlines. A tray is provided that has a plurality of openings therein for receiving a food item. A pair of clamps is coupled to the tray and each of the clamps releasably engages a respective strut on the article of luggage. The tray is horizontally oriented on the top side of the article of luggage when the clamps engage the respective strut. A cover is foldably coupled to the tray and the cover is positionable over a respective one of the openings in the tray to cover the food items in the respective opening.

8 Claims, 7 Drawing Sheets

TRAVEL TRAY ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to travel devices and more particularly pertains to a new travel device for securing an eating tray to an article of luggage.

BRIEF SUMMARY OF THE INVENTION

An embodiment of the disclosure meets the needs presented above by generally comprises an article of luggage that has dimensions that conform to carry-on requirements of commercial airlines. A tray is provided that has a plurality of openings therein for receiving a food item. A pair of clamps is coupled to the tray and each of the clamps releasably engaging a respective strut on the article of luggage. The tray is horizontally oriented on the top side of the article of luggage when the clamps engage the respective strut. A cover is foldably coupled to the tray and the cover is positionable over a respective one of the openings in the tray to cover the food items in the respective opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
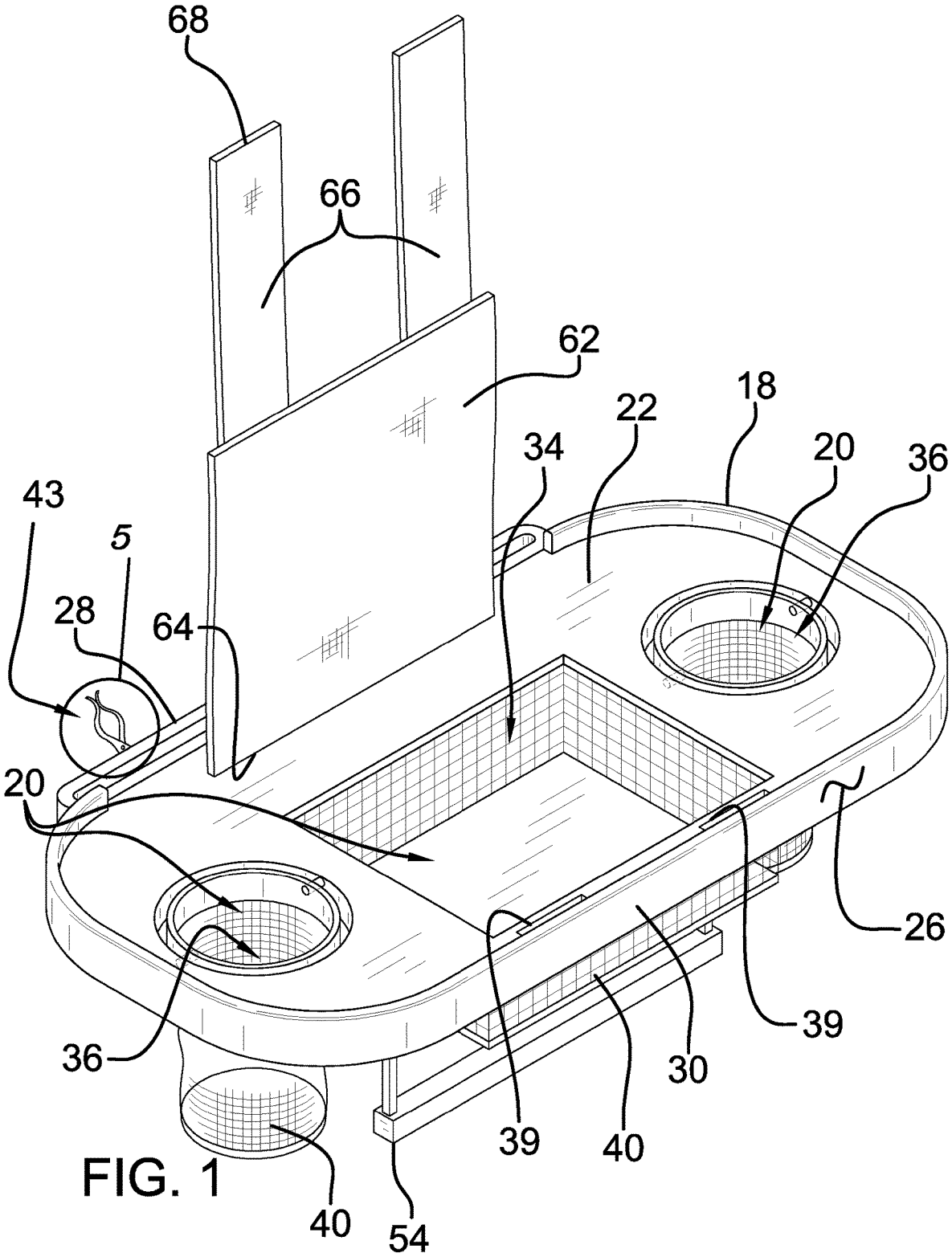
FIG. 1 is a top perspective view of a tray of a travel tray assembly according to an embodiment of the disclosure.
Figure 2:
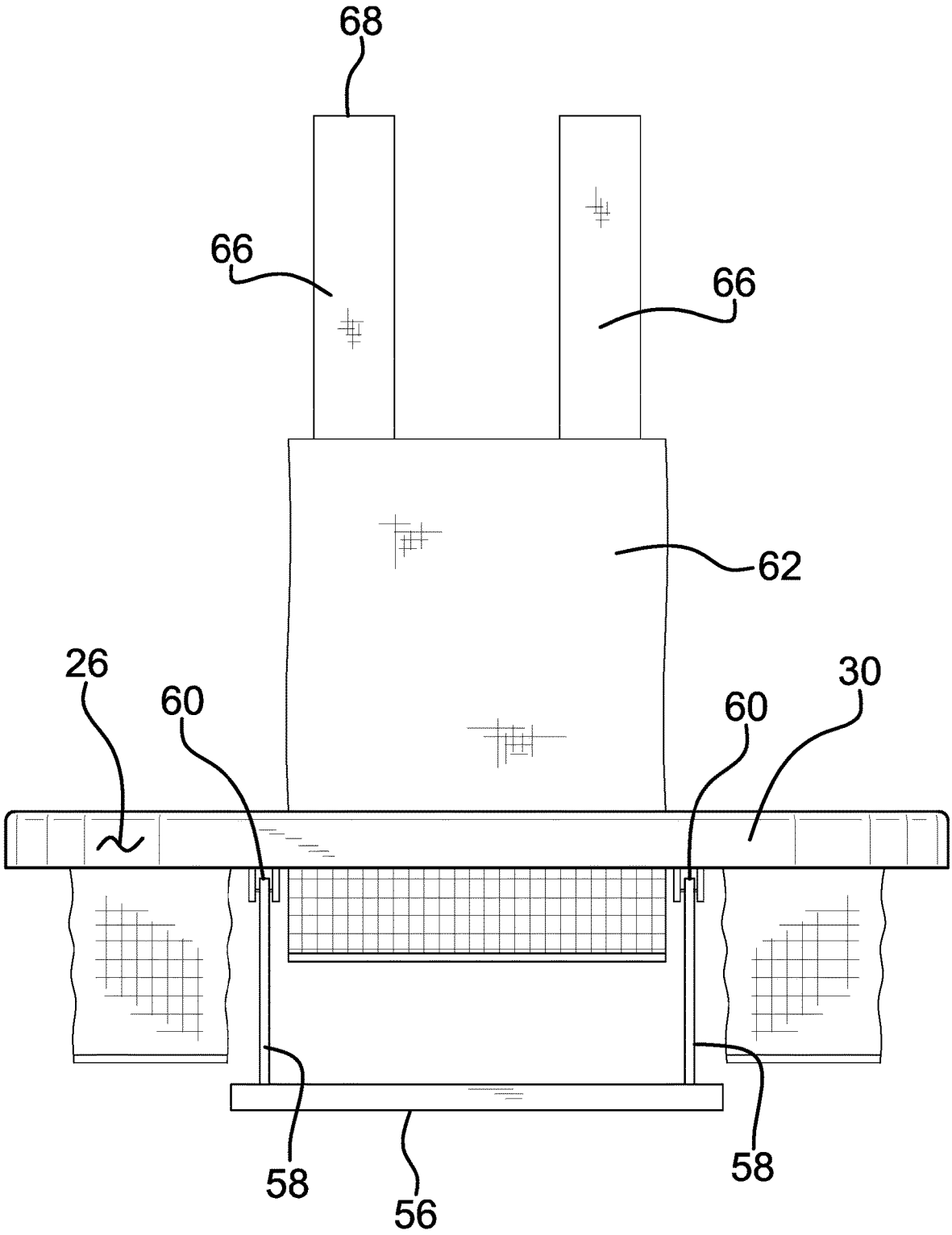
FIG. 2 is a front view of a tray of an embodiment of the disclosure.
Figure 3:
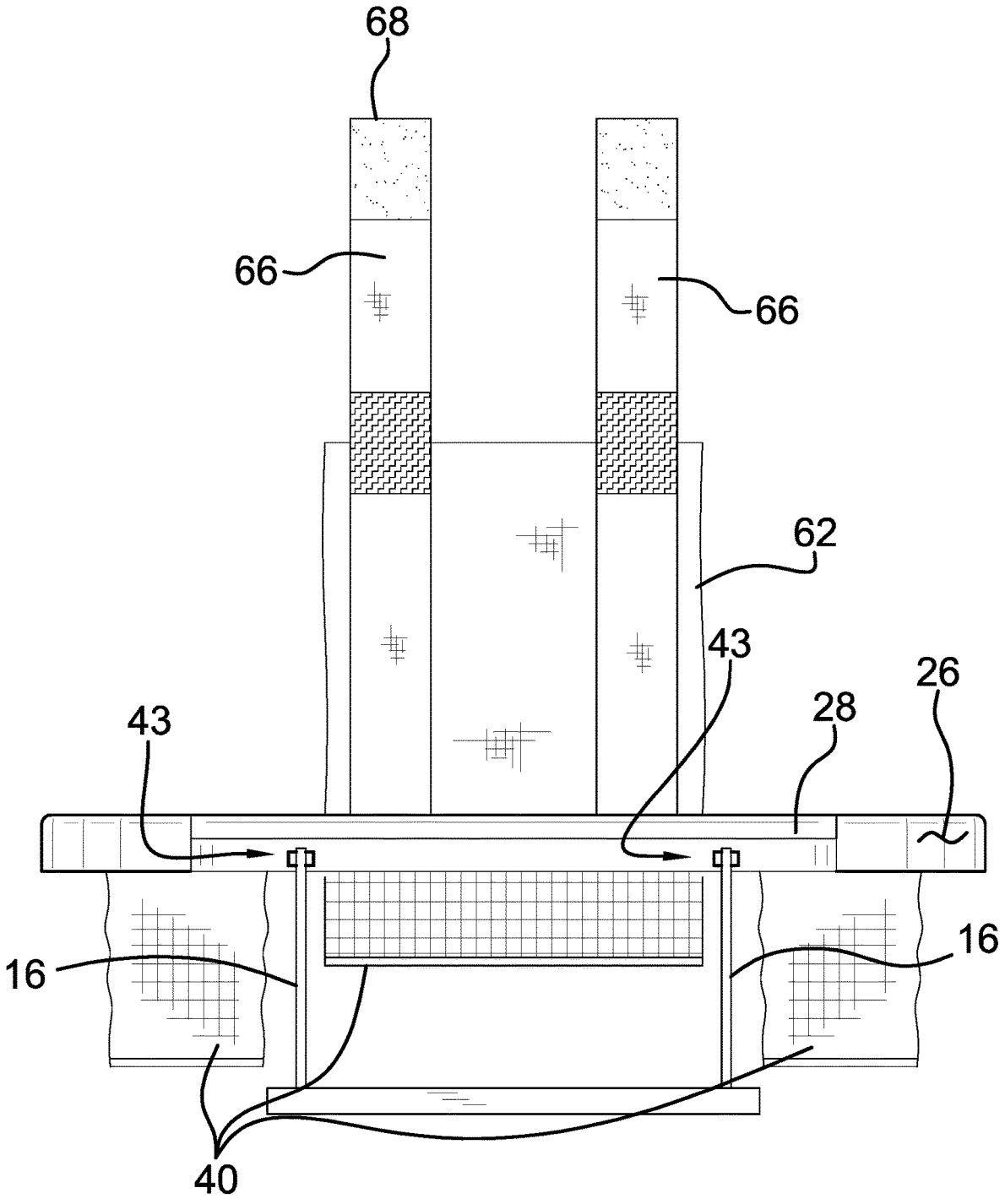
FIG. 3 is a back view of a tray of an embodiment of the disclosure.
Figure 4:
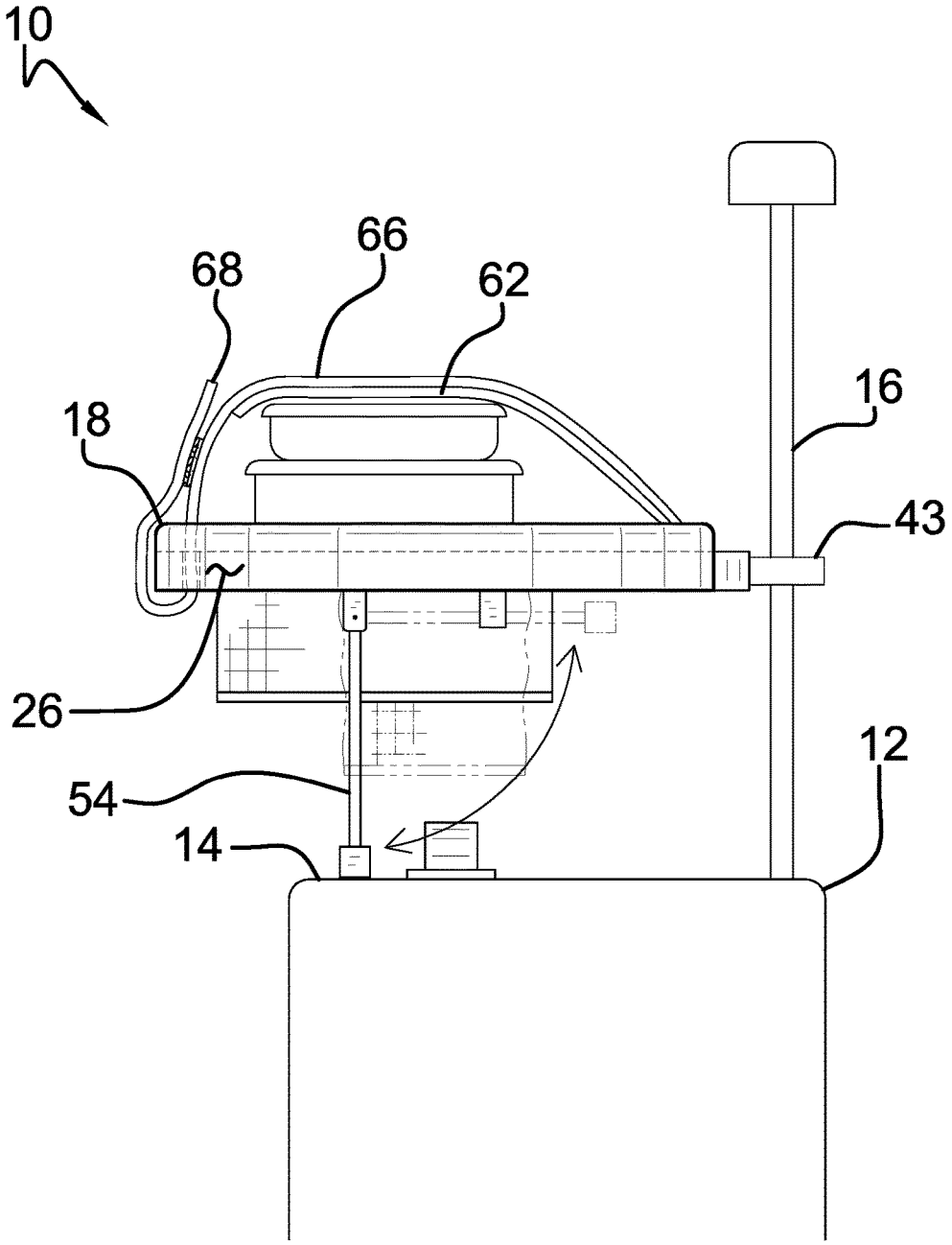
FIG. 4 is a perspective in-use view of an embodiment of the disclosure.
Figure 5:
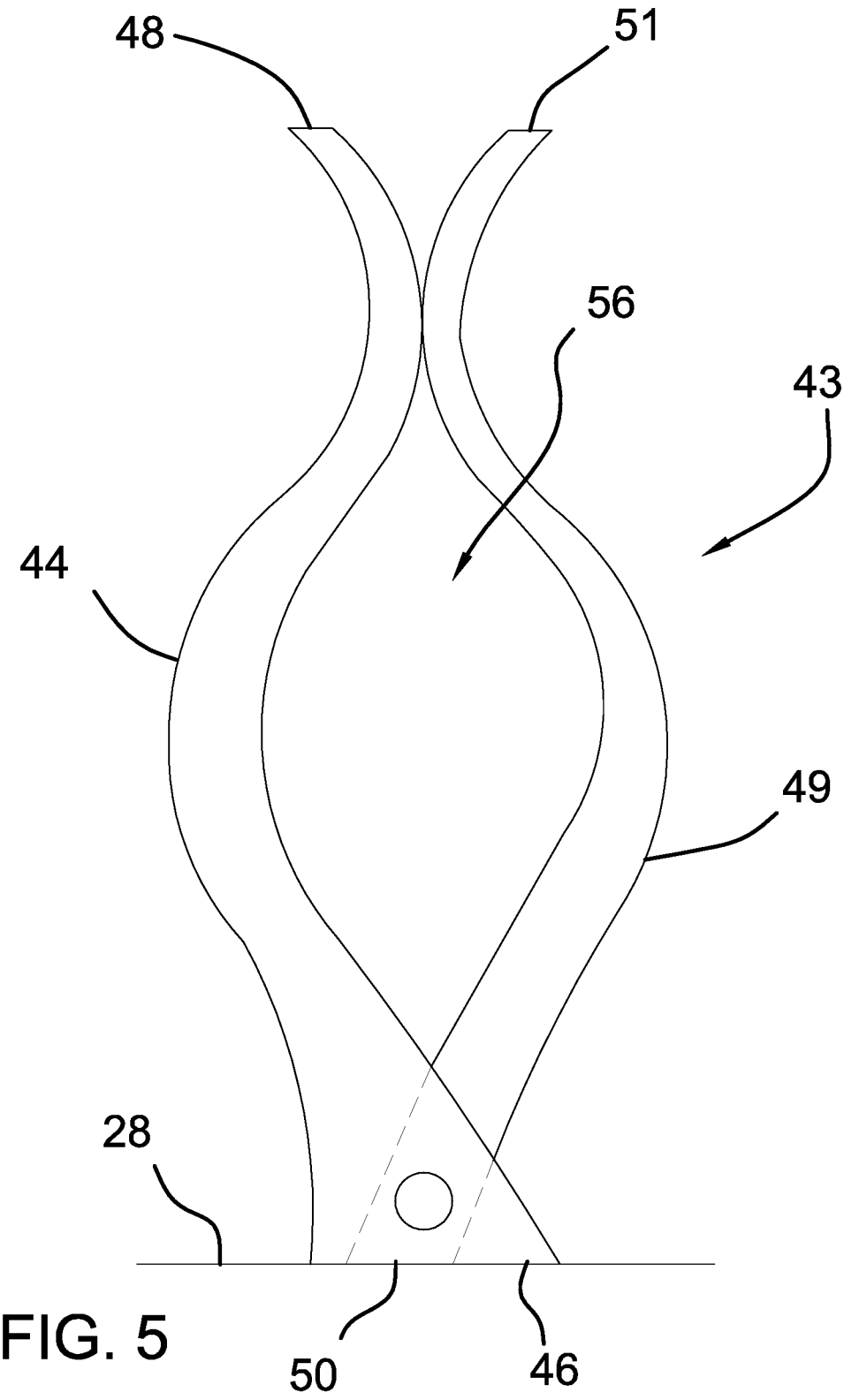
FIG. 5 is a detail view of a clamp taken from circle 5 of FIG. 1 of an embodiment of the disclosure.
Figure 6:
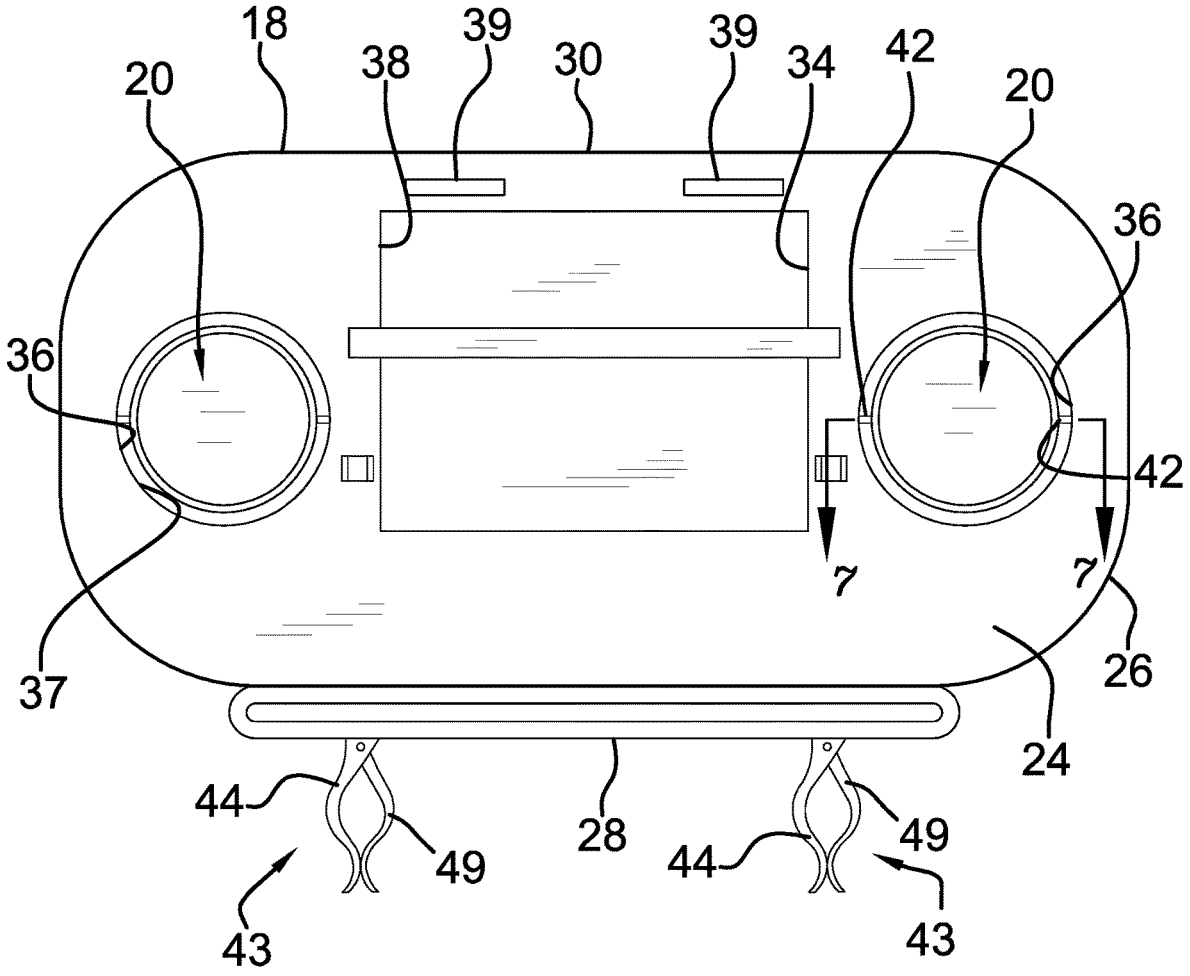
FIG. 6 is a bottom view of a tray of an embodiment of the disclosure.
Figure 7:
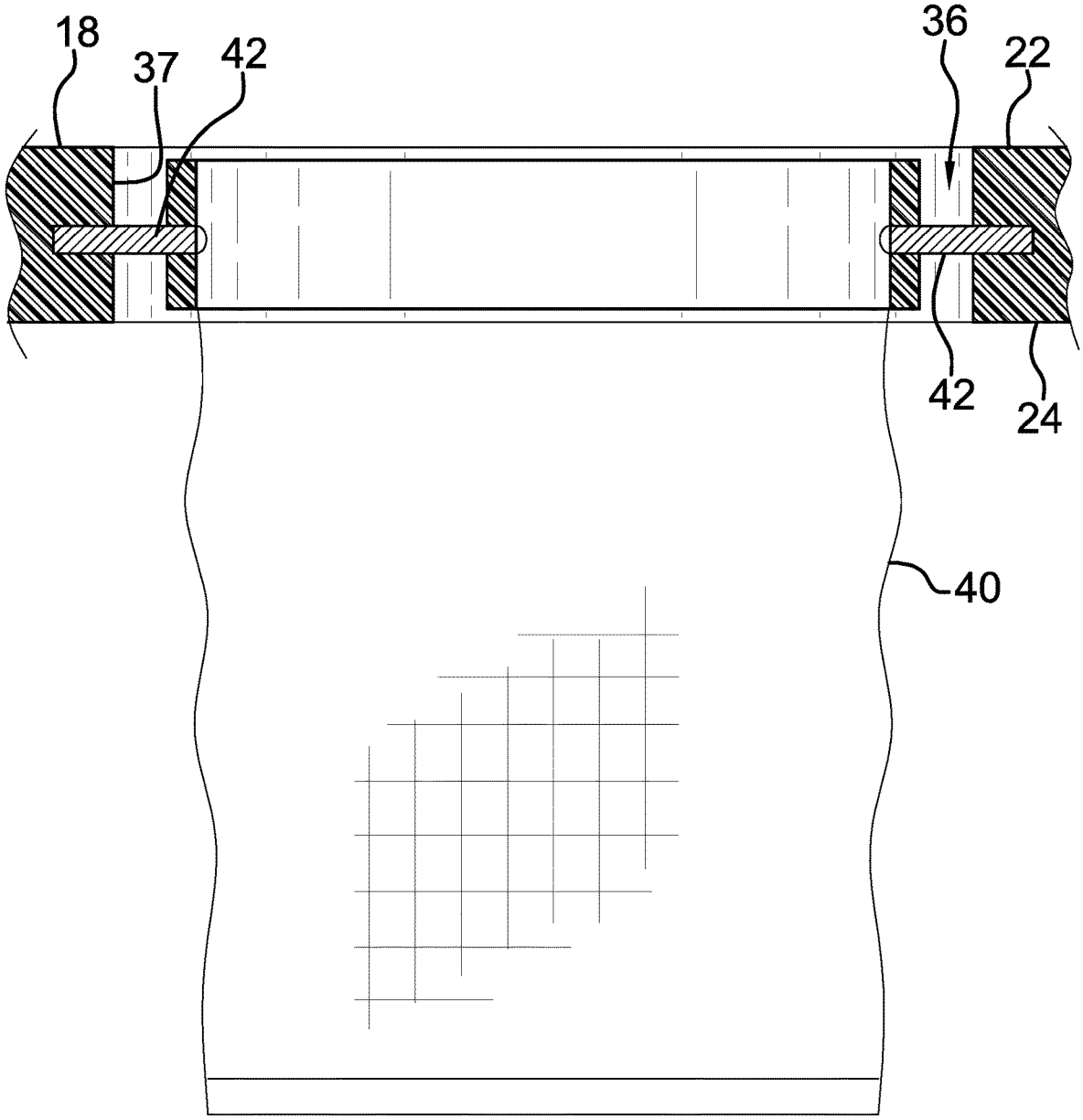
FIG. 7 is a cross sectional view taken along line 7-7 of FIG. 6 of an embodiment of the disclosure.

With reference now to the drawings, and in particular to FIGS. 1 through 7 thereof, a new travel device embodying the principles and concepts of an embodiment of the disclosure and generally designated by the reference numeral 10 will be described.

As best illustrated in FIGS. 1 through 7, the travel tray assembly 10 generally comprises an article of luggage 12 that has dimensions that conform to carry-on requirements of commercial airlines. The article of luggage 12 has a top side 14 and a pair of struts 16 that each extends upwardly therefrom. Each of the struts 16 is associated with a retractable handle on the article of luggage 12. A tray 18 is included that has a plurality of openings 20 therein and each of the openings 20 can have a food item placed therein. In this way the food items can be secured to the article of luggage 12 thereby facilitating the food items to be carried hands-free onto an airplane. Additionally, the tray 18 has dimensions that facilitate the tray 18 to be stored within the article of luggage 12.

The tray 18 has a top side 22, a bottom side 24 and outer surface 26 extending therebetween, and the outer surface 26 has a back side 28 and a front side 30. The top side 22 has a lip 32 extending upwardly therefrom and is coextensive with the outer surface 26 for retaining objects on the top side 22. Each of the openings 20 extends through the top 22 and bottom 24 sides and the plurality of openings 20 includes a tray opening 34 and a pair of beverage openings 36. Each of the beverage openings 36 has a rounded perimeter 37 for receiving a cylindrical beverage container, such as a beverage can or the like. The tray opening 34 is positioned between each of the beverage openings 36 and the tray opening 34 has a rectangular perimeter 38 to receive food containers, such as a food tray, Tupperware containers or other rectangular food containers. The tray 18 has a pair of slots 39 each extending through the top 22 and bottom 24 sides and each of the slots 39 is positioned between the front side 30 of the outer surface 26 and the tray opening 34.

A plurality of nets 40 is each suspended from the bottom side 24 of the tray 18 and each of the nets 40 is aligned with a respective one of the openings 20 for containing the food item in the respective opening. Each of the beverage openings 36 has a respective one of the nets 40 associated therewith. Each of the nets 40 associated with the beverage openings 36 engages a plurality of suspensions 42 that are each coupled to the rounded perimeter 37 of the beverage openings 36. The tray opening 34 has a respective one of the nets 40 associated therewith and the net 38 associated with the tray opening 34 is coupled to and hangs downwardly from the bottom side 24 of the tray 18.

A pair of clamps 43 is provided and each of the clamps 43 releasably engages a respective one of the struts 16 on the article of luggage 12. The tray 18 is horizontally oriented on the top side 22 of the article of luggage 12 when the clamps 43 engage the respective strut. Each of the clamps 43 is positioned on the back side 28 of the outer surface 26 of the tray 18. Each of the clamps 43 comprises a first jaw 44 that has a first end 46 and a second end 48, and the first end 46 is pivotally coupled to the back side 28 of the outer surface 26 of the tray 18. Moreover, the first jaw 44 undulates along an axis extending between the first 46 and second 48 ends. Each of the clamps 43 includes a second jaw 49 that has a primary end 50 and a secondary end 51, and the primary end 50 is pivotally coupled to the back side 28 of the outer surface 26 of the tray 18. The second jaw 49 undulates along an axis extending between the primary 50 and secondary 51 ends.

Each of the first 44 and second 49 jaws is biased toward each other, by a spring or the like, into a closed position having the undulations on each of the first 44 and second 49 jaws being aligned with each other. In this way a circular space 52 is formed between the first 44 and second 49 jaws when the first 44 and second 49 jaws are in the closed position. Moreover, a respective one of the struts 16 is positioned in the circular space 56 having each of the first 44 and second 49 clamps compressing against the respective strut 16. In this way the tray 18 is removably coupled to the struts 16. Each of the first 44 and second 49 jaws is urgeable away from each other into an open position for removing the first 44 and second 49 clamps from the respective strut. Additionally, each of the first 44 and second 49 jaws of each of the clamps 43 may have a resiliently compressible coating for frictionally engaging the struts 16.

A support 54 is hingedly coupled to the tray 18 and the support 54 is positionable in a deployed position such that the support 54 abuts the article of luggage 12 for retaining the tray 18 in the horizontal orientation. The support 54 is positionable in a stored position lying against the tray 18. The support 54 comprises a central member 56 extending between a pair of outward members 58. Each of the outward members 58 has a distal end 60 with respect to the central member 56 and the distal end 60 of each of the outward members 58 is hingedly coupled to the bottom side 24 of the tray 18. The central member 56 is spaced from the bottom side 24 and abuts the top side 22 of the article of luggage 12 when the support 54 is positioned in the deployed position. Additionally, the support 54 may be aligned with the front side 30 of the outer surface 26 of the tray 18.

A cover 62 is foldably coupled to the tray 18 and the cover 62 is positionable over a respective one of the openings 20 in the tray 18. In this way the cover 62 can cover the food items in the respective opening 20 for retaining the food items in the respective opening 20. Thus, the food items can be carried onto the airplane without being able to be spilled or dropped. The cover 62 has a rear edge 64 and the rear edge 64 is coupled to the top side 22 of the tray 18. The cover 62 is positioned between the back side 28 of the outer surface 26 of the tray 18 and the tray opening 34 and the cover 62 is comprised of a deformable material.

A pair of straps 66 is each coupled to the tray 18 and each of the straps 66 lies against the cover 62. Each of the slots 39 is extended through a respective one of the slots 39 in the tray 18 and is matable to themselves for retaining the cover 62 on the food items in the tray opening 34. Each of the straps 66 has a distal end 68 with respect to the top side 22 of the tray 18 and the distal end 68 of each of the straps 66 is extendable through the respective slot 39. Each of the straps 66 may include pair of mating members, such as hook and loop fasteners or the like, to facilitate the straps 66 to be matable to themselves.

In use, each of the clamps 43 is attached to the respective strut 16 on the article of luggage 12 and the support 54 is positioned in the deployed position. Thus, the tray 18 is horizontally oriented above the top side 22 of the article of luggage 12. The food items are positioned in respective ones of the openings 20 to carry the food items on the article of luggage 12. In this way a user can board the airplane without having to carry, and potentially drop or spill, the food items. The cover 62 can be laid over the food items in the tray opening 34 and each of the straps 66 may be extended through the respective slot 39 and be mated to themselves. In this way the cover 62 retains the food items in the tray opening 34 while the article of luggage 12 is being transported.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A travel tray assembly being configured to support food items on an article of luggage, said assembly comprising:

an article of luggage having dimensions that conform to carry-on requirements of commercial airlines, said article of luggage having a top side and a pair of struts each extending upwardly therefrom;

a tray having a plurality of openings therein wherein each of said openings is configured to have a food item placed therein, said tray being having dimensions that facilitate said tray to be stored within said article of luggage;

a plurality of nets, each of said nets being suspended from said tray, each of said nets being aligned with a respective one of said openings wherein each of said nets is configured to contain the food item in said respective opening;

a pair of clamps, each of said clamps being coupled to said tray, each of said clamps releasably engaging a respective one of said struts on said article of luggage, said tray being horizontally oriented on said top side of said article of luggage when said clamps engage said respective strut;

a support being hingedly coupled to said tray, said support being positionable in a deployed position such that said support abuts said luggage for retaining said tray in the horizontal orientation, said support being positionable in a stored position lying against said tray; and a cover being foldably coupled to said tray, said cover being positionable over a respective one of said openings in said tray wherein said cover is configured to cover the food items in said respective opening.

2. The assembly according to claim 1, wherein:

said tray has a top side, a bottom side and an outer surface extending therebetween, said outer surface having a back side and a front side, said top side having a lip extending upwardly therefrom and being coextensive with said outer surface for retaining objects on said top side, each of said openings extending through said top and bottom sides;

said plurality of openings includes a tray opening and a pair of beverage openings, each of said beverage openings having a rounded perimeter wherein each of said beverage openings is configured to receive a cylindrical beverage container, said tray opening being positioned between each of said beverage openings, said tray opening having a rectangular perimeter wherein said tray opening is configured to receive food containers; and said tray has a pair of slots each extending through said top and bottom sides, each of said slots being positioned between said front side of said outer surface and said tray opening.

3. The assembly according to claim 2, wherein each of said beverage openings has a respective one of said nets being associated therewith, each of said nets associated with said beverage openings engaging a plurality of suspensions that are each coupled to said rounded perimeter of said beverage openings, said tray opening having a respective one of said nets being associated therewith, said net associated with said tray opening being coupled to and hanging downwardly from said bottom side of said tray.

4. The assembly according to claim 2, wherein each of said clamps is positioned on said back side of said outer surface of said tray, each of said clamps comprising:

a screw being rotatably coupled to and extending rearwardly away from said back side of said outer surface of said tray, a first jaw having said screw rotatably extending therethrough, said first jaw having a pair of stops thereon, said stops being spaced apart from each other; and a second jaw having said screw rotatably extending therethrough, said second jaw having a pair of stops thereon, said stops on said second jaw being spaced apart from each other and being directed toward a respective one of said stops on said first jaw, a respective one of said struts being positioned between said stops on each of said first and second jaws, each of said first and second jaws being compressed against said respective strut when said screw is tightened, each of said first and second jaws being spaced from said respective strut when said screw is loosened.

5. The assembly according to claim 2, wherein said support comprises a central member extending between a pair of outward members, each of said outward members having a distal end with respect to said central member, said distal end of each of said outward members being hingedly coupled to said bottom side of said tray, said central member being spaced from said bottom side and abutting said top side of said luggage when said support is positioned in said deployed position.

6. The assembly according to claim 2, wherein said cover has a rear edge, said rear edge being coupled to said top side of said tray, said cover being positioned between said back side of said outer surface of said tray and said tray opening, said cover being comprised of a deformable material.

7. The assembly according to claim 6, further comprising a pair of straps, each of said straps being coupled to said tray, each of said straps lying on said cover, each of said straps being extended through a respective one of said slots in said tray and being matable to themselves for retaining said cover on the food items in said tray opening, each of said straps having a distal end with respect to said top side of said tray.

8. A travel tray assembly being configured to support food items on an article of luggage, said assembly comprising:

an article of luggage having dimensions that conform to carry-on requirements of commercial airlines, said article of luggage having a top side and a pair of struts each extending upwardly therefrom;

a tray having a plurality of openings therein wherein each of said openings is configured to have a food item placed therein, said tray being having dimensions that facilitate said tray to be stored within said article of luggage, said tray having a top side, a bottom side and an outer surface extending therebetween, said outer surface having a back side and a front side, said top side having a lip extending upwardly therefrom and being coextensive with said outer surface for retaining objects on said top side, each of said openings extending through said top and bottom sides, said plurality of openings including a tray opening and a pair of beverage openings, each of said beverage openings having a rounded perimeter wherein each of said beverage openings is configured to receive a cylindrical beverage container, said tray opening being positioned between each of said beverage openings, said tray opening having a rectangular perimeter wherein said tray opening is configured to receive food containers, said tray having a pair of slots each extending through said top and bottom sides, each of said slots being positioned between said front side of said outer surface and said tray opening;

a plurality of nets, each of said nets being suspended from said bottom side of said tray, each of said nets being aligned with a respective one of said openings wherein each of said nets is configured to contain the food item in said respective opening, each of said beverage openings having a respective one of said nets being associated therewith, each of said nets associated with said beverage openings engaging a plurality of suspensions that are each coupled to said rounded perimeter of said beverage openings, said tray opening having a respective one of said nets being associated therewith, said net associated with said tray opening being coupled to and hanging downwardly from said bottom side of said tray;

a pair of clamps, each of said clamps being coupled to said tray, each of said clamps releasably engaging a respective one of said struts on said article of luggage, said tray being horizontally oriented on said top side of said article of luggage when said clamps engage said respective strut, each of said clamps being positioned on said back side of said outer surface of said tray, each of said clamps comprising:

a screw being rotatably coupled to and extending rearwardly away from said back side of said outer surface of said tray, a first jaw having said screw rotatably extending therethrough, said first jaw having a pair of stops thereon, said stops being spaced apart from each other; and a second jaw having said screw rotatably extending therethrough, said second jaw having a pair of stops thereon, said stops on said second jaw being spaced apart from each other and being directed toward a respective one of said stops on said first jaw, a respective one of said struts being positioned between said stops on each of said first and second jaws, each of said first and second jaws being compressed against said respective strut when said screw is tightened, each of said first and second jaws being spaced from said respective strut when said screw is loosened;

a support being hingedly coupled to said tray, said support being positionable in a deployed position such that said support abuts said luggage for retaining said tray in the horizontal orientation, said support being positionable in a stored position lying against said tray, said support comprising a central member extending between a pair of outward members, each of said outward members having a distal end with respect to said central member, said distal end of each of said outward members being hingedly coupled to said bottom side of said tray, said central member being spaced from said bottom side and abutting said top side of said luggage when said support is positioned in said deployed position;

a cover being foldably coupled to said tray, said cover being positionable over a respective one of said openings in said tray wherein said cover is configured to cover the food items in said respective opening, said cover having a rear edge, said rear edge being coupled to said top side of said tray, said cover being positioned between said back side of said outer surface of said tray and said tray opening, said cover being comprised of a deformable material; and a pair of straps, each of said straps being coupled to said tray, each of said straps lying on said cover, each of said straps being extended through a respective one of said slots in said tray and being matable to themselves for retaining said cover on the food items in said tray opening, each of said straps having a distal end with respect to said top side of said tray.

* * * * *